US007510001B2

(12) United States Patent
Spring et al.

(10) Patent No.: US 7,510,001 B2
(45) Date of Patent: Mar. 31, 2009

(54) DOWNHOLE ACTUATION TOOLS

(75) Inventors: Christian C. Spring, Houston, TX (US); Matthe Contant, Eindhoven (NL); Kenneth Goodman, Cypress, TX (US); Samuel Tissot, Missouri City, TX (US); Michael Bertoja, Pearland, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 11/307,843

(22) Filed: Feb. 24, 2006

(65) Prior Publication Data

US 2007/0056724 A1 Mar. 15, 2007

Related U.S. Application Data

(63) Continuation-in-part of application No. 11/162,539, filed on Sep. 14, 2005, now Pat. No. 7,337,850.

(60) Provisional application No. 60/596,896, filed on Oct. 28, 2005.

(51) Int. Cl.
*E21B 34/14* (2006.01)

(52) U.S. Cl. ..... 166/66.4; 166/66.6; 166/386; 166/332.2

(58) Field of Classification Search ..... 166/65.1, 166/66.4, 66.6, 316, 330, 386, 332.1, 332.2, 166/373; 251/129.01, 129.11
See application file for complete search history.

(56) References Cited

U.S. PATENT DOCUMENTS

| | | | | |
|---|---|---|---|---|
| 4,593,881 | A | 6/1986 | Yoshino | |
| 5,172,717 | A * | 12/1992 | Boyle et al. | 137/155 |
| 5,234,057 | A * | 8/1993 | Schultz et al. | 166/319 |
| 5,299,640 | A * | 4/1994 | Streich et al. | 166/327 |
| 5,332,035 | A | 7/1994 | Schultz | |
| 5,375,658 | A | 12/1994 | Schultz | |
| 5,490,563 | A | 2/1996 | Wesson | |
| 5,754,495 | A | 5/1998 | Skinner | |
| 5,887,654 | A | 3/1999 | Edwards | |
| 5,890,539 | A | 4/1999 | Huber | |

(Continued)

FOREIGN PATENT DOCUMENTS

EP 0551163 A1 7/1993

(Continued)

*Primary Examiner*—Kenneth Thompson
(74) *Attorney, Agent, or Firm*—Kevin B. McGoff; Trop, Pruner & Hu, P.C.; James L. Kurk

(57) ABSTRACT

Various technologies described herein involve apparatuses for actuating a downhole tool. In one implementation, the apparatus may include a pressure sensor for receiving one or more pressure pulses and an electronics module in communication with the pressure sensor. The electronics module may be configured to determine whether the pressure pulses are indicative of a command to actuate the downhole tool. The apparatus may further include a motor in communication with the electronics module. The motor may be configured to provide a rotational motion. The apparatus may further include a coupling mechanism coupled to the motor. The coupling mechanism may be configured to translate the rotational motion to a linear motion. The apparatus may further include a valve system coupled to the coupling mechanism. The valve system may be configured to actuate the downhole tool when the valve system is in an open phase.

26 Claims, 6 Drawing Sheets

U.S. PATENT DOCUMENTS

| | | | | |
|---|---|---|---|---|
| 5,964,296 | A * | 10/1999 | Ross | 166/373 |
| 5,983,743 | A | 11/1999 | McGregor | |
| 6,012,518 | A | 1/2000 | Pringle | |
| 6,182,750 | B1 | 2/2001 | Edwards | |
| 6,182,764 | B1 | 2/2001 | Vaynshteyn | |
| 6,213,203 | B1 | 4/2001 | Edwards | |
| 6,244,351 | B1 | 6/2001 | Patel | |
| 6,321,838 | B1 | 11/2001 | Skinner | |
| 6,354,374 | B1 | 3/2002 | Edwards | |
| 6,536,529 | B1 | 3/2003 | Kerr | |
| 6,550,538 | B1 | 4/2003 | Herrmann | |
| 6,568,656 | B1 | 5/2003 | Wrocklage | |
| 6,805,163 | B2 | 10/2004 | Lee | |
| 6,918,357 | B2 | 7/2005 | Norris | |
| 2002/0046845 | A1 | 4/2002 | Rayssiguier | |
| 2003/0150606 | A1 | 8/2003 | Biester | |
| 2004/0149949 | A1 | 8/2004 | Eriksson | |

FOREIGN PATENT DOCUMENTS

| | | | |
|---|---|---|---|
| EP | 0593122 | A2 | 4/1994 |
| EP | 0604155 | A1 | 6/1994 |
| GB | 2333790 | A | 8/1999 |
| GB | 2406123 | | 3/2005 |
| WO | 01/57358 | | 8/2001 |

* cited by examiner

DOWNHOLE ACTUATION TOOLS

CROSS-REFERENCE TO RELATED APPLICATIONS

The present application is a continuation-in-part of U.S. patent application Ser. No. 11/162,539 filed on Sep. 14, 2005 U.S. Pat. No. 7,337,850 issued 4 Mar. 2008. The present application also claims priority of U.S. Provisional Patent Application Ser. No. 60/596,896 filed on Oct. 28, 2005.

BACKGROUND

1. Field of the Invention

Implementations of various technologies described herein generally relate to downhole actuation tools.

2. Description of the Related Art

The following descriptions and examples are not admitted to be prior art by virtue of their inclusion within this section.

Mechanical rupture discs and shear-pins have been widely used as a method for controlling the actuation of downhole tools, such as packers, valves and the like. However, for some applications where maximum pressures may be limited, downhole assemblies may be complex and multiple tools may need to be controlled serially, mechanical rupture discs and shear-pins may not provide sufficient control.

Therefore, a need may exist in the art for improved methods and apparatuses for actuating downhole tools.

SUMMARY

Described herein are implementations of various technologies for an apparatus for actuating a downhole tool. In one implementation, the apparatus may include a pressure sensor for receiving one or more pressure pulses and an electronics module in communication with the pressure sensor. The electronics module may be configured to determine whether the pressure pulses are indicative of a command to actuate the downhole tool. The apparatus may further include a motor in communication with the electronics module. The motor may be configured to provide a rotational motion. The apparatus may further include a coupling mechanism coupled to the motor. The coupling mechanism may be configured to translate the rotational motion to a linear motion. The apparatus may further include a valve system coupled to the coupling mechanism. The valve system may be configured to actuate the downhole tool when the valve system is in an open phase.

In another implementation, the valve system may include a lead screw coupled to the coupling mechanism, a sealing plug disposed inside a plug port, and a pin coupled to the lead screw. The pin may be configured to confine the sealing plug inside the plug port when the valve system is in a closed phase. The valve system may further include a valve channel in communication with the plug port and a compression spring disposed inside the valve channel.

In yet another implementation, the valve system may include an atmospheric chamber and a vent port in communication with the atmospheric chamber. The valve system may further include a lead screw coupled to the coupling mechanism, an o-ring disposed inside the atmospheric chamber and a sealing pin disposed between the lead screw and the vent port through the o-ring such that the sealing pin and the o-ring form a seal with the vent port, when the valve system is in a closed phase.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION

As used here, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
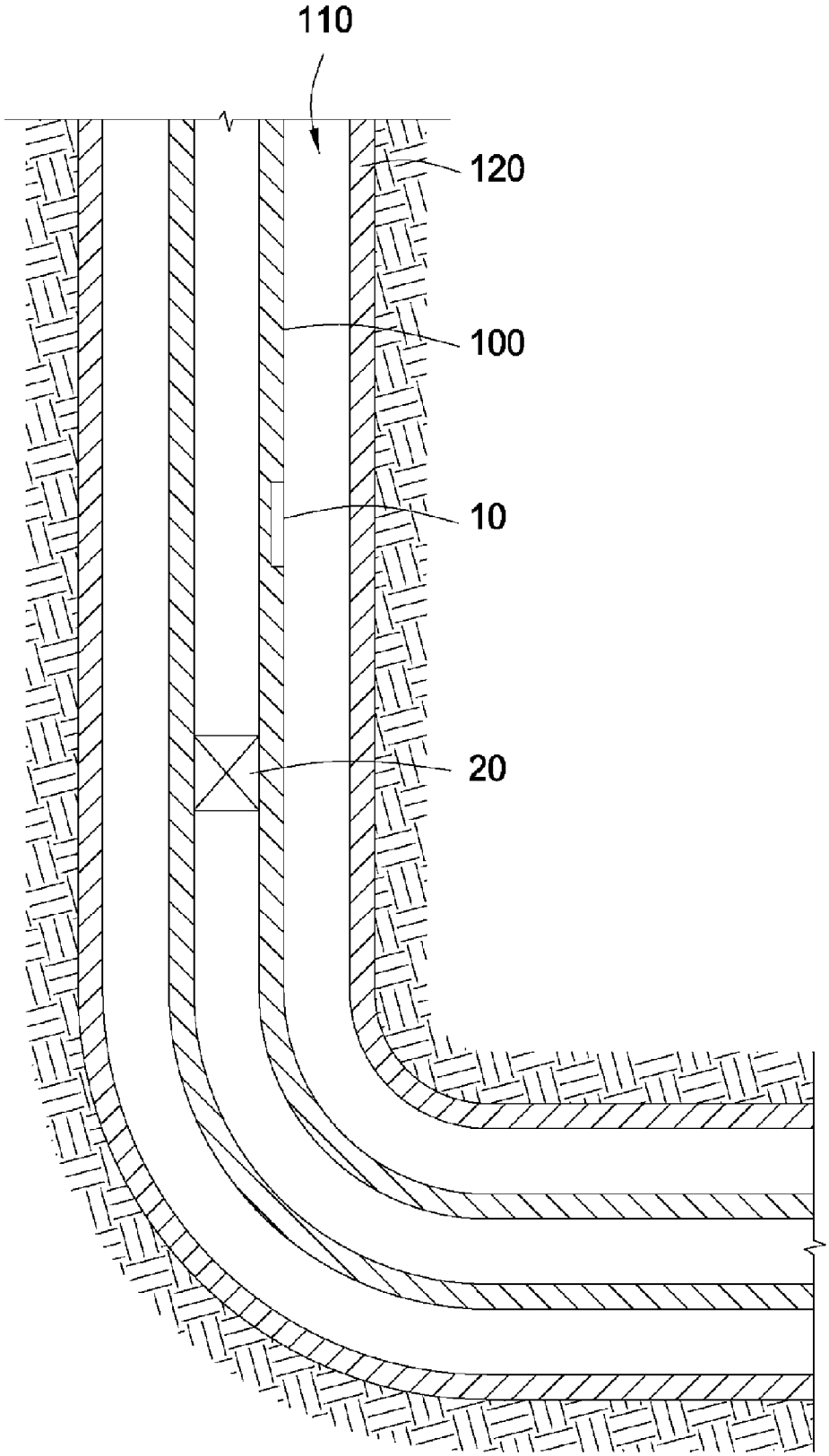
FIG. 1 illustrates a schematic diagram of a tubing string that may include a downhole actuation tool in accordance with implementations of various technologies described herein.

FIG. 1 illustrates a schematic diagram of a tubing string 100 that may include a downhole actuation tool 10 in accordance with implementations of various technologies described herein. The tubing string 100 may be disposed inside a wellbore 110, which may be lined with a casing or liner 120. In one implementation, the downhole actuation tool 10 may be disposed on an outside surface of the tubing string 100. It should be understood, however, that in some implementations the downhole actuation tool 10 may be disposed anywhere on the tubing string 100, including inside the tubing string 100. The downhole actuation tool 10 may be configured to actuate a downhole tool 20, such as a ball valve, a sliding sleeve, a packer, a cutting tool or any other downhole tool commonly known by persons having ordinary skill in the art. Illustratively, the downhole actuation tool 10 may be disposed above the downhole tool 20. It is to be understood that in some implementations the downhole actuation tool 10 may be disposed below the downhole tool 20 or at the substantially the same level as the downhole tool 20.

Figure 2:
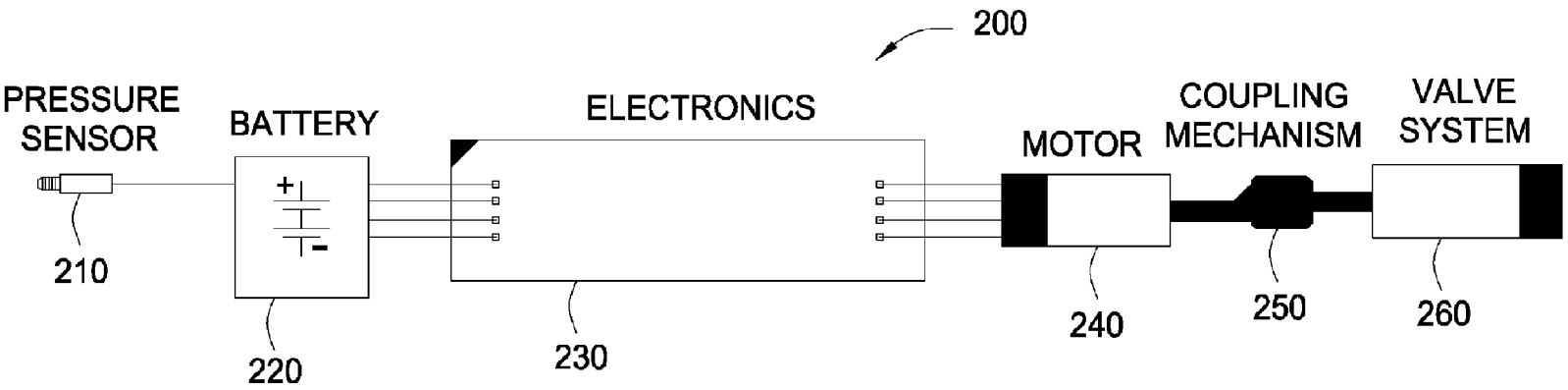
FIG. 2 illustrates a block diagram of a downhole actuation tool in accordance with implementations of various technologies described herein.

FIG. 2 illustrates a block diagram of a downhole actuation tool 200 in accordance with implementations of various technologies described herein. In one implementation, the downhole actuation tool 200 may include a pressure sensor 210, a battery 220, an electronics module 230, a motor 240, a coupling mechanism 250 and a valve system 260.

Figure 3:
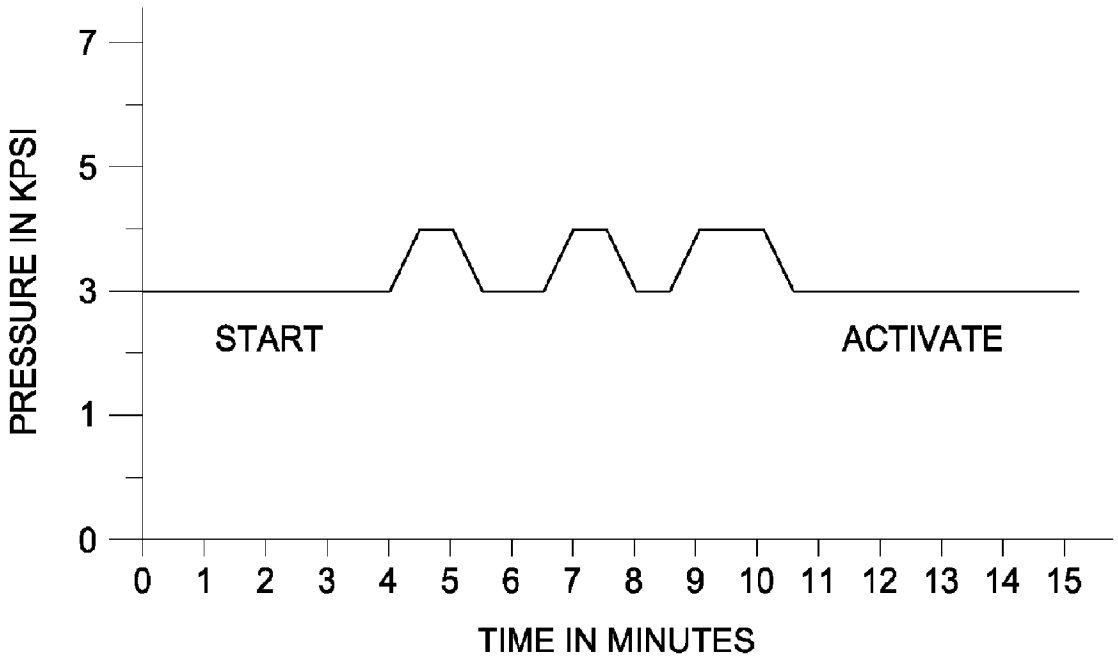
FIG. 3 illustrates a series of pressure pulses that may be used to trigger the downhole actuation tool in accordance with various implementations described herein.

The pressure sensor 210 may be configured to receive pressure pulses. FIG. 3 illustrates a series of pressure pulses that may be used in accordance with various implementations described herein. The vertical axis in FIG. 3 represents pressure in kpsi, while the horizontal axis represents time in minutes. In one implementation, the pressure sensor 210 may be a pressure transducer. Although implementations of various technologies described herein are described with reference to a pressure sensor, it should be understood that other implementations may use other types of sensing devices, such as light transducers, acoustic transducers, electromagnetic wave transducers and the like.

The battery 220 may be configured to supply electrical energy to the electronics module 230 and the motor 240. Although implementations of various technologies are described herein with reference to a battery as the power source, it should be understood that in some implementations other types of power source, such as, fuel cell, turbine generators and the like, may be used to supply energy to the electronics module 230 and the motor 240.

Figure 4:
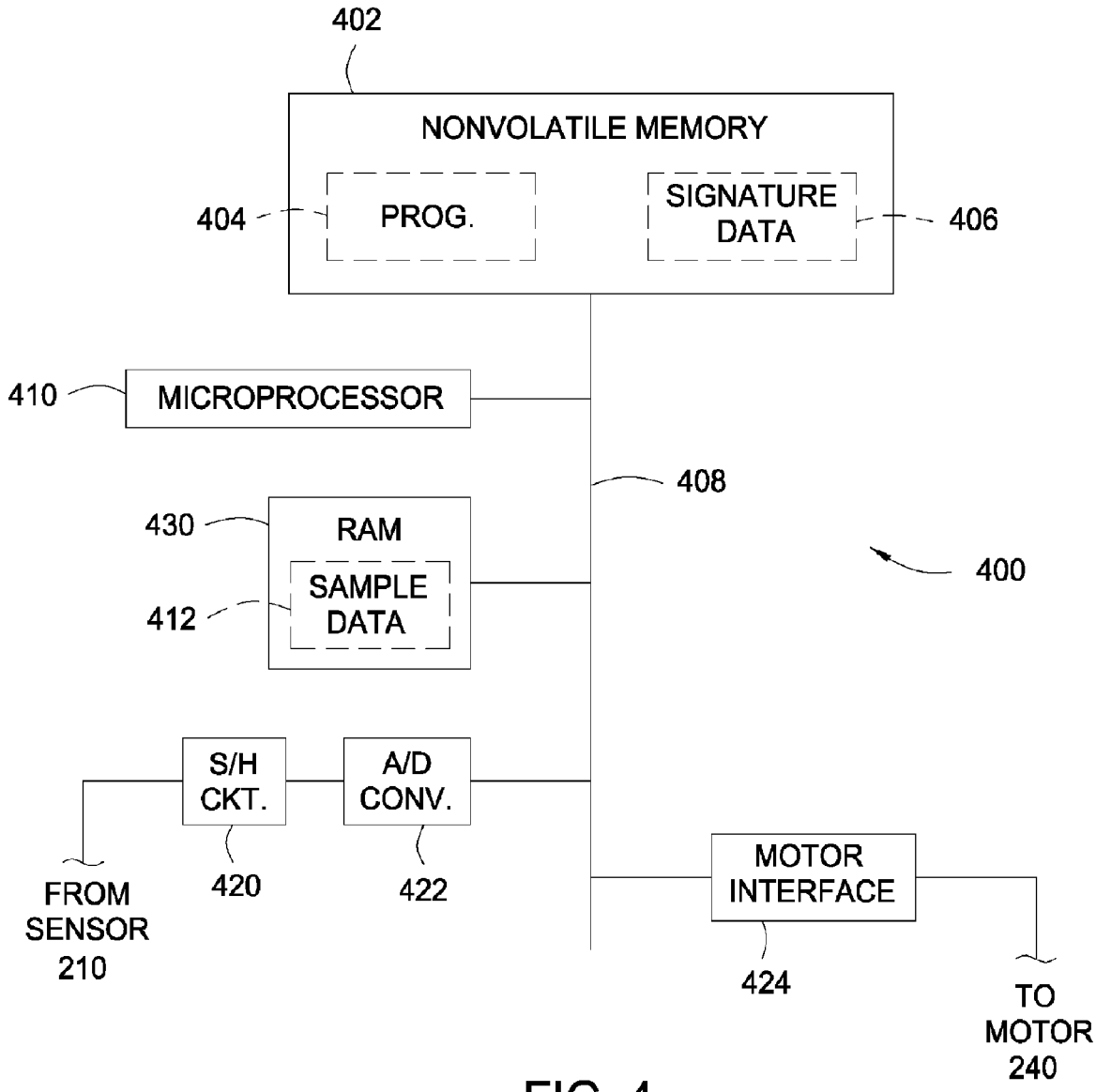
FIG. 4 illustrates a schematic diagram of an electronics module that may be used to interpret the pressure pulses in accordance with various implementations described herein.

FIG. 4 illustrates an electronics module 400 that may be used in various implementations described herein. In one implementation, the electronics module 400 may include a microprocessor 410 coupled via a bus 408 to a non-volatile memory 402 (e.g., a read only memory (ROM)) and a random access memory (RAM) 430. An analog-to-digital (A/D) converter 422 and a motor interface 424 may also be coupled to the bus 408. The non-volatile memory 402 may be configured to store instructions that form a computer program 404 that, when executed by the microprocessor 410, causes the microprocessor 410 to detect the pressure pulses and recognize sequences of pressure pulses as commands to activate the motor 240. The non-volatile memory 402 may also be configured to store signature data 406 that correspond to various sequences of pressure pulses. Such signature data may be used by the microprocessor 410 to interpret sequences of pressure pulses.

The A/D converter 422 may be coupled to a sample and hold (S/H) circuit 420 that may be configured to receive an analog signal from the pressure sensor 210 indicative of the sensed pressure pulse. The S/H circuit 420 may be configured to sample the analog signal and provide the sampled signal to the A/D converter 422, which in turn may convert the sampled signal into digital sampled data 412 stored in the RAM 430. The electronics module 400 along with the pressure sensor 210 and the battery 220 may be described in more detail in commonly assigned U.S. Pat. Nos. 6,182,764; 6,550,538 and 6,536,529, which are incorporated herein by reference. Although various implementations are described herein with reference to the electronics module 400, it should be understood that some implementations may use a microcontroller having all the functionality of the electronics module 400. In addition, in some implementations, the S/H circuit 420 may be an optional component of the motor 400.

The motor 240 may be configured to apply torque or turning force to the coupling mechanism 250. The motor 240 may be coupled to the coupling mechanism 250 through an output shaft (not shown). In one implementation, the motor 240 may include a transmission, such as a planetary gear configured transmission with a ratio of approximately 600 to 1, for example. In another implementation, the motor 240 may be a stepper motor.

Figure 5A:
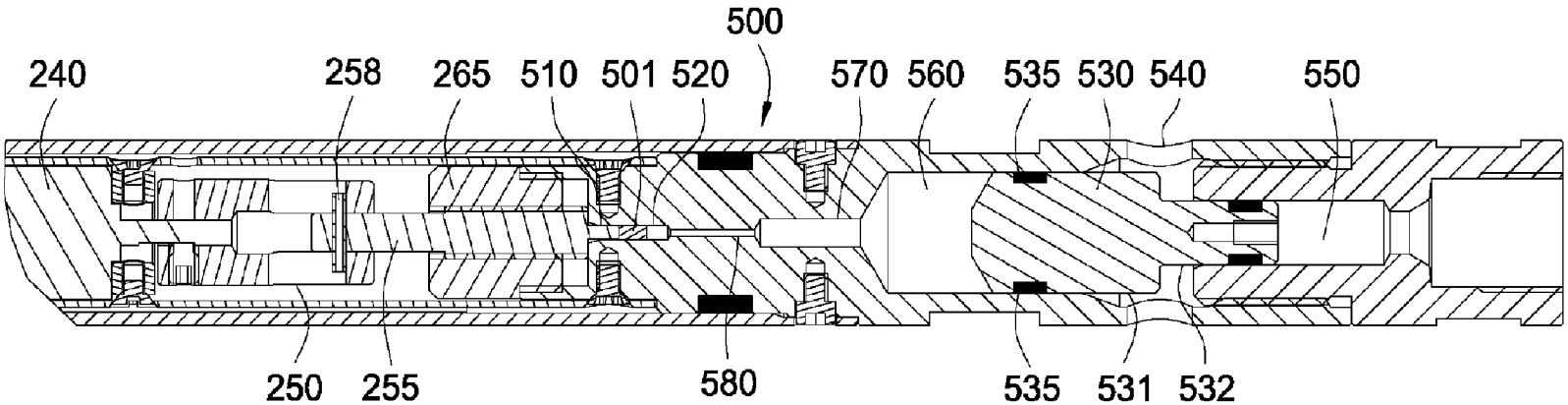
FIG. 5A illustrates a schematic diagram of a valve system in a closed phase in accordance with one implementation of various technologies described herein.

The coupling mechanism 250 may be configured to receive the torque from the motor 240 and use that torque to turn a lead screw 255 connected thereto, as shown in FIG. 5A. In this manner, the coupling mechanism 250 may be configured to translate a rotational motion, i.e., the torque received from the motor 240, to a linear motion, i.e., by linearly moving the lead screw 255 in response to the torque. In one implementation, the coupling mechanism 250 may be connected to the output shaft of the motor 240 with a set screw (not shown) to facilitate easy removal of the valve system 260 from the motor 240. It should be understood, however, that in some implementations the coupling mechanism 250 may be connected to the output shaft of the motor 240 by other means, such as a press-fit pin. In another implementation, the coupling mechanism 250 may be a shaft coupling mechanism. In yet another implementation, the coupling mechanism 250 may be connected to the lead screw 255 with a press-fit pin 258. While the lead screw 255 is inserted into the coupling mechanism 250, the press-fit pin 258 may be pressed into a transversely-drilled hole through the lead screw 255. The press-fit pin 258 is held captive but free to slide in a transverse machined slot through the coupling mechanism 250 that allows both rotational and linear motion of the lead screw 255 to occur when the coupling mechanism 250 is turned by the motor 240.

In one implementation, the lead screw 255 may be an ACME screw. However, it should be understood that other types of lead screws may be used in other implementations. The lead screw 255 may be configured to linearly move within a nut 265. That is, the lead screw 255 may move in and out of the nut 265 based on the direction of the torque. Accordingly, the nut 265 may be an ACME nut, thereby making the lead screw 255 and the nut 265 a matched set. In one implementation, the lead screw 255 and the nut 265 may be a ¼-20 ACME screw and nut. The pitch and starts of the lead screw 255 may be configured to determine the torque required to back out the lead screw 255 to open the valve system 260. For instance, a single start lead screw and nut may have negative efficiency for back driving, and as such, the motor 240 may provide the torque to back out the lead screw. On the other hand, a more efficient lead screw and nut with multiple starts and higher lead angles may have positive efficiency for back driving, and as such, the motor 240 may provide the braking torque to prevent the lead screw 255 from backing out when pressure is applied to the valve system 260. In this manner, the back driving characteristics of the multi-start lead screw and nut may be used to advantage of designing an essentially zero electrical power operated, high pressure valve system. In one implementation, on one end of the lead screw 255, the threads may be removed and a small diameter hole may be drilled cross ways to accept the press-fit pin 258 used to connect to the coupling mechanism 250.

In another implementation, the other end of the lead screw 255 may include a small diameter pin 510 machined for holding a sealing plug 501 in place. In one implementation, the pin 510 may be free floating, i.e., not coupled to the lead screw 255. The sealing plug 501 may be used to form a high pressure seal at a plug port 520. The elastomeric function of the sealing plug 501 is similar to an o-ring. The sealing plug 501 may be configured to fill the void between the pin 510 and the cylinder wall of the plug port 520 when energized by either the compression of the pin 510 and/or hydraulic pressure, which will be described in more detail in the paragraphs below. Thus, the sealing plug 501, when placed inside the plug port 520 and held in place by the pin 510, may form a high pressure seal with the plug port 520. The diameter of the pin 510, the diameter of the plug port 520 and the dimensions of the sealing plug 501 may be designed to complement each other to form an effective seal. In one implementation, the diameter of the plug port 520 and the diameter of the sealing plug 501 may be configured to minimize the amount of power applied by the motor 240 to open the valve system 260.

The valve system 260 may further include an inlet port 540 and a control line 550. In an open phase, well fluid from outside the downhole actuation tool 200 may flow from the inlet port 540 through the control line 550 to the downhole tool 20, as will be described in more detail later. The valve system 260 may further include a pilot (or floating) piston 530 to facilitate the open and closed phases of the valve system 260. The pilot piston 530 may include a large portion 531 disposed inside a valve chamber 560 and a small portion 532 disposed inside the control line 550. The pilot piston 530 may be sealed to the valve chamber 560 with o-rings 535.

The valve system 260 may further include a valve channel 570 coupled to the valve chamber 560. The valve channel 570 may be configured such that its flow area is significantly less than the flow area of the valve chamber 560. In one implementation, the flow area of the valve chamber 560 is about 0.071 inches$^3$ while the flow area of the valve channel 570 is 0.001 inches$^3$. As such, the flow area of the valve chamber 560 is about 74 times greater than the flow area of the valve channel 570. The valve system 260 may further include a restriction channel 580 connecting the plug port 520 with the valve channel 570. In one implementation, the diameter of the restriction channel 580 is smaller than the diameter of the plug port 520.

In one implementation, the space between the sealing plug 501 and the pilot piston 530 may be filled with hydraulic oil. That space may be defined by a portion of the plug port 520, the restriction channel 580, the valve channel 570 and a portion of the valve chamber 560. Although the valve system 260 may be described herein with reference to hydraulic oil, it should be understood that in some implementations the valve system 260 may use any non-compressible fluid that may be used downhole, such as DC200-1000CS silicone oil made by Dow Corning from Midland, Mich.

FIG. 5A illustrates a schematic diagram of the valve system 500 in a closed phase in accordance with implementations of various technologies described herein. In the closed phase, no electrical signal or power is applied to the motor 240. The motor 240 functions as a brake to prevent back drive. The coupling mechanism 250 transfers the braking action from the motor 240 to the lead screw 255. The pin 510 confines the sealing plug 501 inside the plug port 520 to seal off the valve chamber 560. The hydraulic oil prevents the pilot piston 530 from moving when external pressure from well fluid is applied against the pilot piston 530. Because the hydraulic oil expands with increase in temperature, the pilot piston 530 may be positioned inside the valve chamber 560 in a way that would allow the pilot piston 530 to move in response to temperature changes.

Figure 5B:
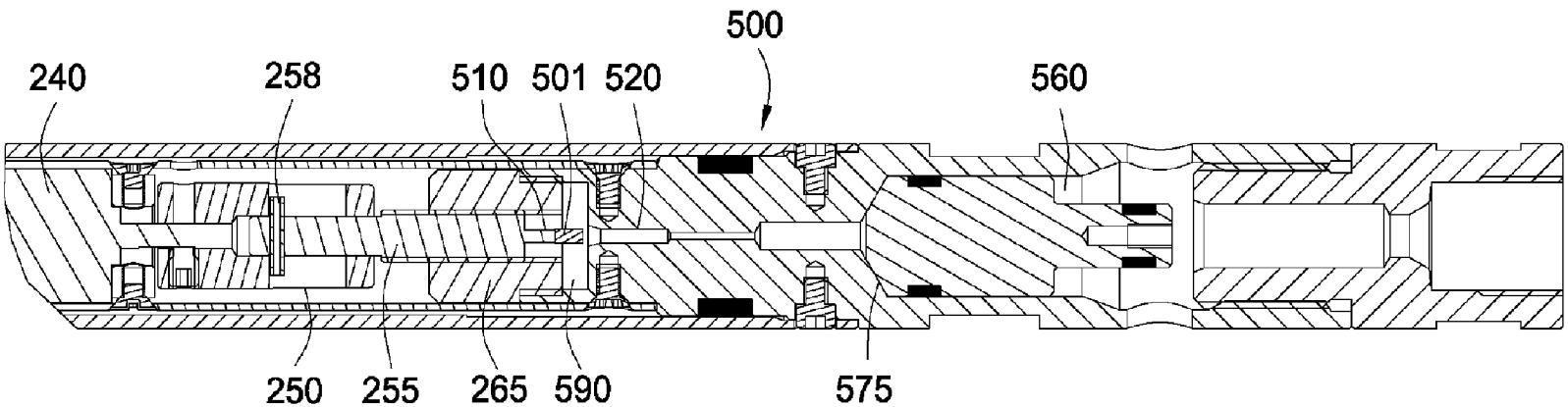
FIG. 5B illustrates a schematic diagram of a valve system in an open phase in accordance with one implementation of various technologies described herein.

FIG. 5B illustrates a schematic diagram of the valve system 500 in an open phase in accordance with implementations of various technologies described herein. During the opening phase, electrical signal or power may be applied to the motor 240 to cause the motor 240 to turn. In one implementation, less than one watt is applied to the motor 240 to open the valve system 500. In response, the coupling mechanism 250 may cause the lead screw 255 to retract from the nut 265, i.e., to move toward the motor 240. As the lead screw 255 is turned, the pin 510 is withdrawn from the plug port 520, allowing the sealing plug 501 to be pushed out by pressure from the hydraulic oil. Once the sealing plug 501 is removed from the plug port 520, the hydraulic oil begins to flow out of the plug port 520. As the hydraulic oil flows from the plug port 520 to an atmospheric chamber 590, the pilot piston 530 moves toward the direction of the sealing plug 501 until a stopping region 575 of the valve chamber 560 is reached. The stopping region 575 may have a variety of finish, including drill point, flat, radiused and the like. As the pilot piston 530 moves toward the sealing plug 501, communication between the inlet port 540 and the control line 550 is opened, allowing well fluid to flow from the inlet port 540 through the control line 550 to the downhole tool 20. In one implementation, the volume of the atmospheric chamber 590 is greater than the volume of the valve chamber 560. In another implementation, once the downhole actuation tool 200 is opened, it may not be closed without redressing the downhole actuation tool 200.

Figure 6A:
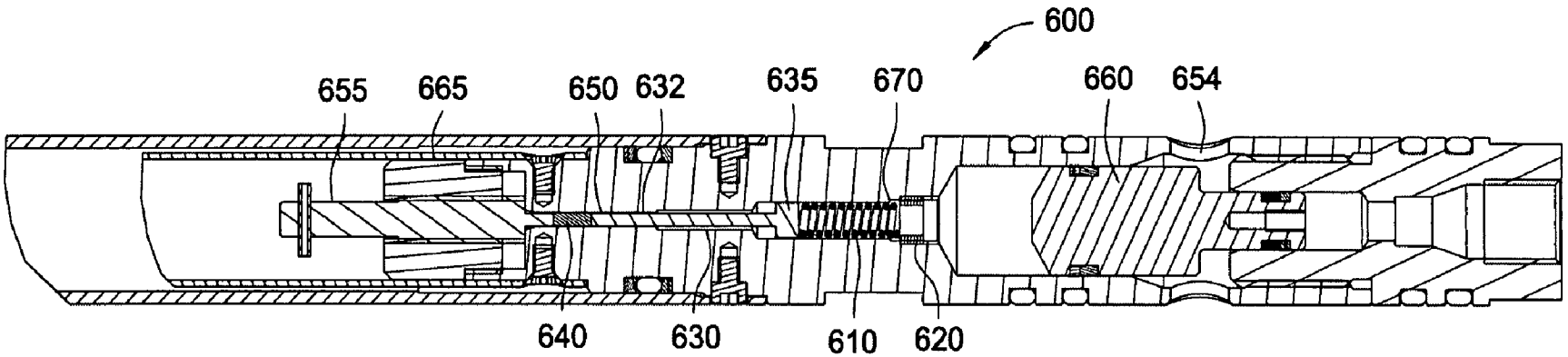
FIG. 6A illustrates a schematic diagram of a valve system in a closed phase in accordance with another implementation of various technologies described herein.

FIG. 6A illustrates a schematic diagram of a valve system 600 in a closed phase in accordance with implementations of various technologies described herein. In one implementation, the valve system 600 includes the same components as the valve system 500 described in the above paragraphs, with a few exceptions. For example, the valve system 600 may include a compression spring 610 disposed inside a valve channel 670. In one implementation, the compression spring 610 may be held inside the valve channel 670 by a hollow set screw 620.

The valve system 600 may further include a floating pin 630 disposed between the compression spring 610 and a sealing plug 640. The floating pin 630 may have a piston portion 632 configured to press against the sealing plug 640 and a cylindrical portion 635 configured to provide a shoulder for the compression spring 610 to press against. The compression spring 610 may be configured to push the floating pin 630 against the sealing plug 640, thereby squeezing the sealing plug 640 between the floating pin 630 and a lead screw 655. When squeezed, the sealing plug 640 may shorten axially and expand radially, thereby causing the sealing plug 640 to fit tight against a plug port 650 and create a pressure seal. In one implementation, the diameter of the piston portion 635 is smaller than the diameter of the plug port 650. In another implementation, the diameter of the cylindrical portion 635 is substantially the same as the diameter of the compression spring 610. In this manner, the compression spring 610 against the sealing plug 640 allows the sealing plug 640 to seal well at low pressure as well as at high pressure.

In the closed phase, no electrical signal or power is applied to the motor 240. As with the valve system 500, the motor 240 functions as a brake to prevent back drive. The coupling mechanism 250 transfers the braking action from the motor 240 to the lead screw 655, which confines the sealing plug 640 inside the plug port 650. The hydraulic oil between the sealing plug 640 and a pilot piston 660 prevents the pilot piston 660 from moving when external pressure from well fluid is applied against the pilot piston 660.

Figure 6B:
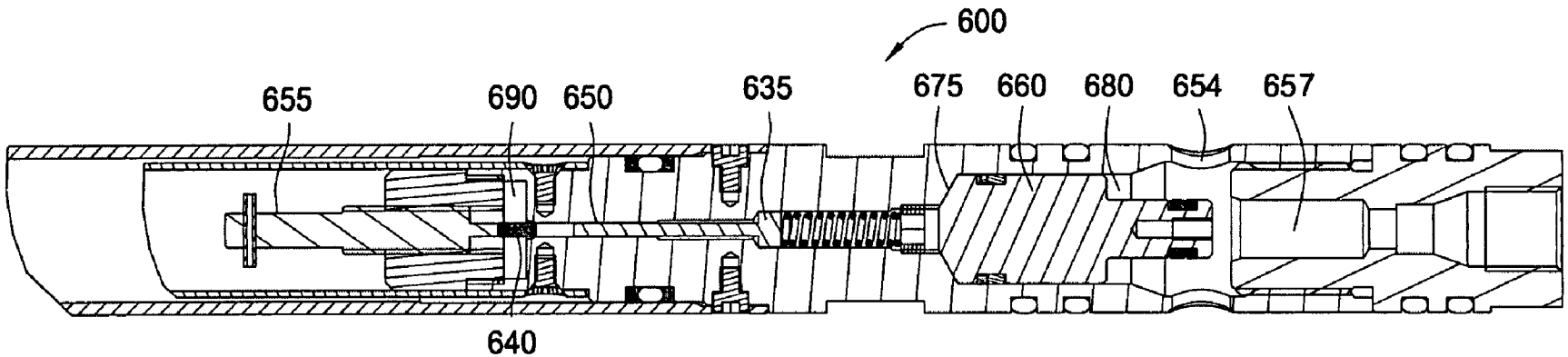
FIG. 6B illustrates a schematic diagram of a valve system in an open phase in accordance with another implementation of various technologies described herein.

FIG. 6B illustrates a schematic diagram of the valve system 600 in an open phase in accordance with implementations of various technologies described herein. During the opening phase, electrical signal or power may be applied to the motor 240 to cause the motor 240 to turn. In response, the coupling mechanism 250 may cause the lead screw 655 to retract from the nut 665, i.e., to move toward the motor 240. As the lead screw 655 is withdrawn from the plug port 650, the sealing plug 640 is set free to be pushed out by pressure from the hydraulic oil and the compression spring 610 pushing against the floating pin 630. As the hydraulic oil drains from the plug port 650 into an atmospheric chamber 690, the pilot piston 660 moves toward the direction of the sealing plug 640 until a stopping region 675 of the valve chamber 680 is reached. In one implementation, the volume of the atmospheric chamber 690 is greater than the volume of the valve chamber 680. As the pilot piston 660 moves toward the sealing plug 640, communication between an inlet port 654 and a control line 657 is opened, allowing well fluid to flow from the inlet port 654 through the control line 657 to the downhole tool 20.

Figure 7A:
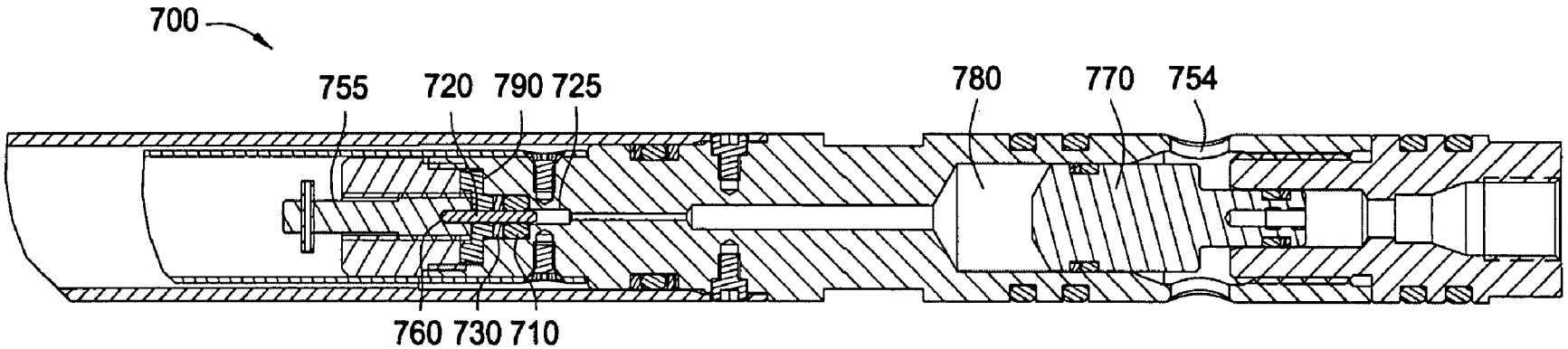
FIG. 7A illustrates a schematic diagram of a valve system in a closed phase in accordance with yet another implementation of various technologies described herein.

FIG. 7A illustrates a schematic diagram of a valve system 700 in a closed phase in accordance with implementations of various technologies described herein. In one implementation, the valve system 700 includes the same components as the valve system 500 described in the above paragraphs, with a few exceptions. For instance, in lieu of the sealing plug 501, the valve system 700 may include an o-ring 710 disposed inside an atmospheric chamber 790. The valve system 700 may further include a sealing pin 720 disposed between a lead screw 755 and a vent port 725 through the o-ring 710. A portion of the sealing pin 720 may be disposed inside the o-ring 710 to form a seal with the o-ring 710. A back up disc 730 may be disposed adjacent the o-ring 710 to enhance the reliability of the o-ring 710. In one implementation, the sealing pin 720 may be held by a recess portion 760 of a lead screw 755. As such, in the closed phase, the sealing pin 720 and the o-ring 710 may be configured to seal a vent port 725. In another implementation, as opposed to free floating, the sealing pin 720 may be coupled to the lead screw 755. The diameter of the sealing pin 720, the diameter of the vent port 725 and the dimensions of the o-ring 710 may be designed to complement each other to form an effective seal. In one implementation, a 0.062 diameter sealing pin may be used to form a seal with the o-ring 710.

In the closed phase, the o-ring 710 fills the void between the sealing pin 720 and the center hole of the back up disc 730 and the void between the wall of the atmospheric chamber 790 and the back up disc 730, when energized by either the compression of the sealing pin 720 and/or hydraulic pressure. In one implementation, the o-ring 710 may be a fluorocarbon Viton® elastomer with a durometer of 95, which may be made by DuPont Dow Elastomers from Wilmington, Del. However, it should be understood that in some implementations the o-ring 710 may be made from any elastomer material rated for downhole environment.

In the closed phase, no electrical signal or power is applied to the motor 240. The motor 240 functions as a brake to prevent any back drive. The coupling mechanism 250 transfers the braking action from the motor 240 to the lead screw 755. The hydraulic oil prevents the pilot piston 770 from moving when external pressure from well fluid is applied against the pilot piston 770.

Figure 7B:
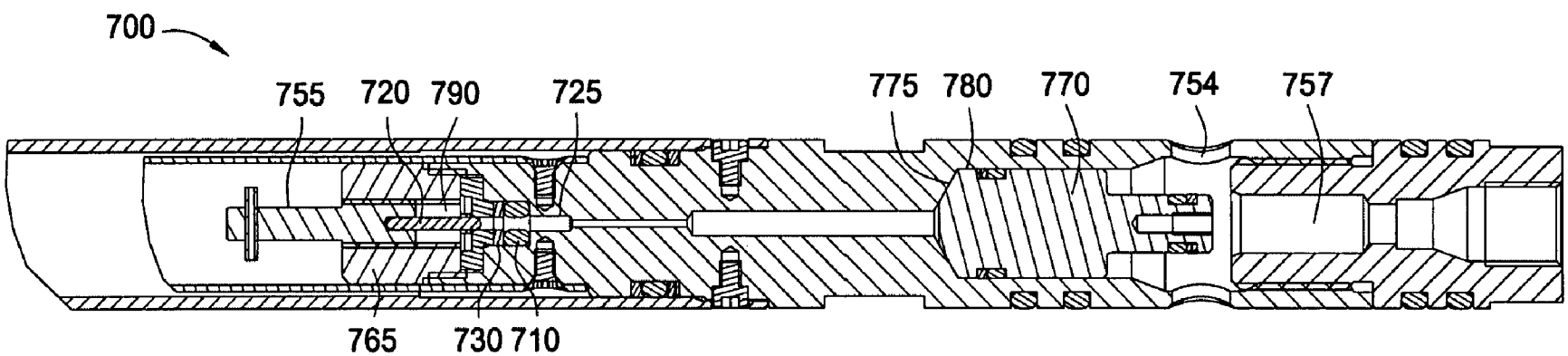
FIG. 7B illustrates a schematic diagram of a valve system in an open phase in accordance with yet another implementation of various technologies described herein.

FIG. 7B illustrates a schematic diagram of the valve system 700 in an open phase in accordance with implementations of various technologies described herein. During the opening phase, electrical signal or power may be applied to the motor 240 causing the motor 240 to turn. In response, the coupling mechanism 250 may cause the lead screw 755 to retract from the nut 765, i.e., to move toward the motor 240. As the lead screw 755 is turned, the sealing pin 720 is withdrawn from the o-ring 710. If the sealing pin 720 is coupled to the lead screw 755, the lead screw 755 will pull the sealing pin 720 from the o-ring 710 at the cost of higher o-ring friction and higher torque requirements from the motor 240. On the other hand, if the sealing pin 720 is loose or free to turn with respect to the lead screw 755, the o-ring friction is not transferred to the lead screw 755 and the motor torque requirements are reduced; however, hydraulic pressure may be required to withdraw the sealing pin 720 from the o-ring 710. As the hydraulic oil that was trapped between the sealing pin 720 and the pilot piston 770 drains from the vent port 725 into the atmospheric chamber 790, the pilot piston 770 moves toward the direction of the o-ring 710 until the stopping region 775 of the valve chamber 780 is reached. As the pilot piston 770 moves toward the direction of the o-ring 710, communication between an inlet port 754 and a control line 757 is opened, allowing well fluid to flow from the inlet port 754 through the control line 757 to the downhole tool 20. In one implementation, the volume of the atmospheric chamber 790 is greater than the volume of the valve chamber 780. Although implementations of various technologies have described the flow of well fluid from the inlet port to the control line, it should be understood that in other implementations the well fluid may flow from the control line to the inlet port.

In this manner, various implementations of the downhole actuation tool may be used as a rupture disc. One advantage various downhole actuation tool implementations have over conventional rupture discs is that various downhole actuation tool implementations are not limited by depth or pressure, since they may be actuated by a sequence of pressure pulses. Furthermore, various downhole actuation tool implementations may also provide more precision in controlling downhole tool actuation. Various downhole actuation tool implementations may be operated using less than one watt of power applied to the motor 240 and a differential pressure ranging from less than 1 kpsi to greater than 20 kpsi. Such differential pressure may be caused by the trapped low pressure in the atmospheric chamber and the high pressure from well fluid.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus comprising:

a downhole tool to be actuated by pressure exerted by well fluid; and a downhole actuation tool, comprising:

an inlet port in communication with the well fluid;

a pressure sensor for receiving one or more pressure pulses;

an electronics module in communication with the pressure sensor, wherein the electronics module is configured to determine whether the pressure pulses are indicative of a command to actuate the downhole tool;

a motor in communication with the electronics module, wherein the motor is configured to provide a rotational motion;

a coupling mechanism coupled to the motor, wherein the coupling mechanism is configured to translate the rotational motion to a linear motion; and a valve system coupled to the coupling mechanism to control communication between the inlet port and a control line extending to the downhole tool to selectively isolate the downhole tool from the pressure exerted by the well fluid, wherein the valve system is configured to transition to an open phase to communicate the pressure to the downhole tool to actuate the downhole tool.

2. The apparatus of claim 1, wherein the command to actuate the downhole tool comprises a command to activate the motor.

3. The apparatus of claim 1, wherein the valve system comprises a lead screw coupled to coupling mechanism.

4. The apparatus of claim 3, wherein the coupling mechanism is configured to linearly move the lead screw upon receipt of the rotational motion from the motor.

5. The apparatus of claim 3, wherein the valve system comprises: a sealing plug disposed inside a plug port; and a pin coupled to the lead screw, wherein the pin is configured to confine the sealing plug inside the plug port.

6. The apparatus of claim 5, wherein the sealing plug and the pin are configured to form a seal with the plug port.

7. The apparatus of claim 1, wherein lead screw is configured to withdraw the pin from the plug port to allow the sealing plug to be pushed out of the plug port by hydraulic pressure, when the linear motion is applied to the lead screw.

8. The apparatus of claim 5, wherein the valve system further comprises:

a valve channel in communication with the plug port; and a valve chamber in communication with the valve channel.

9. The apparatus of claim 8, wherein the valve system further comprises a pilot piston disposed inside the valve chamber and is configured to linearly move within the valve chamber.

10. The apparatus of claim 9, wherein the valve system further comprises hydraulic oil disposed between the sealing plug and the pilot piston.

11. The apparatus of claim 10, wherein the hydraulic oil is configured to prevent the pilot piston from moving when external pressure from well fluid is applied against the pilot piston.

12. The apparatus of claim 10, wherein the hydraulic oil is configured to flow out of the plug port once the sealing plug is pushed out of the plug port.

13. The apparatus of claim 9, wherein the valve system further comprises:

an inlet port in communication with well fluid; and a control line configured to facilitate communication between the inlet port and a downhole tool, when the motor is activated by the command to actuate the downhole tool.

14. The apparatus of claim 13, wherein the pilot piston is configured to move toward the sealing plug to open communication between the inlet port and the control line, when the valve system is in the open phase.

15. An apparatus for actuating a downhole tool, comprising:

a pressure sensor for receiving one or more pressure pulses;

an electronics module in communication with the pressure sensor, wherein the electronics module is configured to determine whether the pressure pulses are indicative of a command to actuate the downhole tool; a motor in communication with the electronics module, wherein the motor is configured to provide a rotational motion;

a coupling mechanism coupled to the motor, wherein the coupling mechanism is configured to translate the rotational motion to a linear motion; and a valve system configured to actuate the downhole tool when the valve system is in an open phase, wherein the valve system comprises:

a lead screw coupled to the coupling mechanism;

a sealing plug disposed inside a plug port; a pin coupled to the lead screw, wherein the pin is configured to confine the sealing plug inside the plug port when the valve system is in a closed phase;

a valve channel in communication with the plug port; and a compression spring disposed inside the valve channel.

16. The apparatus of claim 15, wherein the valve system further comprises a floating pin disposed between the sealing plug and the compression spring.

17. The apparatus of claim 16, wherein the compression spring is configured to push the floating pin against the sealing plug.

18. The apparatus of claim 16, wherein the lead screw is configured to withdraw the pin from the plug port to allow the sealing plug to be pushed out of the plug port by hydraulic pressure and the compression spring pushing the floating pin against the sealing plug, when the linear motion is applied to the lead screw.

19. An apparatus for actuating a downhole tool, comprising:

a pressure sensor for receiving one or more pressure pulses;

an electronics module in communication with the pressure sensor, wherein the electronics module is configured to determine whether the pressure pulses are indicative of a command to actuate the downhole tool;

a motor in communication with the electronics module, wherein the motor is configured to provide a rotational motion;

a coupling mechanism coupled to the motor, wherein the coupling mechanism is configured to translate the rotational motion to a linear motion; and a valve system configured to actuate the downhole tool when the valve system is in an open phase, wherein the valve system comprises:

an atmospheric chamber;

a vent port in communication with the atmospheric chamber;

a lead screw coupled to the coupling mechanism;

an o-ring disposed inside the atmospheric chamber; and a sealing pin disposed between the lead screw and the vent port through the o-ring such that the sealing pin and the o-ring form a seal with the vent port, when the valve system is in a closed phase.

20. The apparatus of claim 19, wherein the sealing pin is disposed through the o-ring to form the seal.

21. The apparatus of claim 19, wherein the lead screw is coupled to a nut and is configured to rotate within the nut.

22. The apparatus of claim 21, wherein the coupling mechanism is configured to retract the lead screw from the nut upon receipt of the rotational motion from the motor.

23. The apparatus of claim 22, wherein the sealing pin is configured to withdraw from the o-ring as the lead screw is retracted from the nut.

24. The apparatus of claim 22, wherein the valve system further comprises:

a valve chamber in communication with the vent port;

a pilot piston disposed inside the valve chamber;

hydraulic oil disposed between the o-ring and the pilot piston;

an inlet port in communication with well fluid; and a control line configured to facilitate communication between the inlet port and a downhole tool, when the motor is activated by the command to actuate the downhole tool.

25. The apparatus of claim 24, wherein the hydraulic oil is configured to flow out of the vent port as the sealing pin is withdrawn from the o-ring.

26. The apparatus of claim 25, wherein the pilot piston is configured to move toward the o-ring as the hydraulic oil flows out of the vent port to facilitate communication between the inlet port and the control line.

* * * * *